US011498811B2

(12) United States Patent
Durand et al.

(10) Patent No.: US 11,498,811 B2
(45) Date of Patent: Nov. 15, 2022

(54) ELEVATOR DISPLAY SYSTEMS

(71) Applicant: Otis Elevator Company, Farmington, CT (US)

(72) Inventors: Romain Durand, Amilly (FR); Laurie Babot, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 875 days.

(21) Appl. No.: 16/392,853

(22) Filed: Apr. 24, 2019

(65) Prior Publication Data

US 2019/0330024 A1 Oct. 31, 2019

(30) Foreign Application Priority Data

Apr. 27, 2018 (EP) ..... 18305536

(51) Int. Cl.
*B66B 11/02* (2006.01)
*B66B 5/00* (2006.01)
*B66B 11/00* (2006.01)

(52) U.S. Cl.
CPC ..... *B66B 11/0246* (2013.01); *B66B 5/0087* (2013.01); *B66B 11/0025* (2013.01)

(58) Field of Classification Search
CPC ..... B66B 11/0246; B66B 5/0087; B66B 11/0025; B66B 11/0226; B66B 11/0253
See application file for complete search history.

(56) References Cited

U.S. PATENT DOCUMENTS 6,230,845 B1 * 5/2001 Yamakawa ..... B66B 11/001 187/314
6,691,833 B1 * 2/2004 Elsener ..... B66B 11/0246 187/254
2017/0297870 A1 * 10/2017 Fauconnet ..... B66B 11/0226
2018/0037440 A1 * 2/2018 Blondel ..... B66B 11/0233
2018/0105395 A1 * 4/2018 Cortes ..... B66B 11/0253
2018/0339879 A1 * 11/2018 Quaretti ..... B66B 3/023
2019/0330024 A1 * 10/2019 Durand ..... B66B 11/0226
(Continued)

FOREIGN PATENT DOCUMENTS

CN 1568280 A 1/2005
CN 201415899 Y 3/2010
CN 1923659 B 11/2010
(Continued)

OTHER PUBLICATIONS

European Search Report for EP Application No. 18305536.7, International Filing Date Apr. 27, 2018, dated Oct. 24, 2018, 8 pages.

*Primary Examiner* — Michael A Riegelman
(74) *Attorney, Agent, or Firm* — Cantor Colburn LLP

(57) ABSTRACT

Elevator cars are provided herein. The elevator cars include a wall panel defining part of a passenger space of the elevator car, two or more receiving rails arranged on an exterior of the wall panel, and an elevator display system having a viewing panel and an enclosure housing a display screen. The viewing panel is mounted to the wall panel on an interior of the wall panel and the enclosure is engageable with the receiving rails on the exterior of the wall panel such that the display screen is movably positioned relative to the viewing panel to be viewable from within the passenger space in an installed position.

18 Claims, 8 Drawing Sheets

(56) References Cited

U.S. PATENT DOCUMENTS

2021/0371232 A1* 12/2021 Huron ..... B66B 1/3423

FOREIGN PATENT DOCUMENTS

| | | | |
|---|---|---|---|
| CN | 107337055 | A | 11/2017 |
| EP | 1533265 | A1 | 5/2005 |
| EP | 1174381 | A1 | 6/2009 |
| EP | 2859912 | A1 | 4/2015 |
| EP | 3088342 | A1 | 11/2016 |
| EP | 3288884 | A1 | 3/2018 |
| EP | 3530604 | A1 * | 8/2019 |
| JP | 2009062104 | A | 3/2009 |
| JP | 6194065 | B1 * | 9/2017 |
| JP | 2017218290 | A | 12/2017 |
| WO | 2007132500 | A1 | 11/2007 |
| WO | 2017005327 | A1 | 1/2017 |
| WO | 2017157468 | A1 | 9/2017 |

* cited by examiner

ELEVATOR DISPLAY SYSTEMS

CROSS REFERENCE TO RELATED APPLICATIONS

This application claims the benefit of European Application No. 18305536.7, filed Apr. 27, 2018, which is incorporated herein by reference in its entirety.

BACKGROUND

The subject matter disclosed herein generally relates to elevator systems and, more particularly, to elevator display systems.

Elevator systems include various components that require maintenance actions to be performed thereon, including, but not limited to, inspection, repair, and replacement. Typically, such maintenance operations may be time consuming and various safety requirements imposed thereon. For example, for some maintenance operations, access to an elevator shaft may be required by a mechanic to perform such maintenance operations. It may be advantageous to provide improved systems to increase safety and/or reduce costs associated with maintenance of elevator systems.

Some such components may include displays located in or on an elevator car. Typically, such displays are mounted relative to and/or behind elevator car wall panels. The wall panels may be required to be opened or removed to enable maintenance to be performed on the displays. During such maintenance operations, damage may occur to the wall panels, to the displays, and/or to other aspects of the elevator system. Moreover, performing such maintenance may be time consuming and require elevator system downtime, e.g., out-of-service, to perform such maintenance. Accordingly, it may be advantageous to have improved systems associated with displays of elevator cars to improve maintenance thereof.

SUMMARY

According to some embodiments, elevator cars are provided. The elevator cars include a wall panel defining part of a passenger space of the elevator car, two or more receiving rails arranged on an exterior of the wall panel, and an elevator display system having a viewing panel and an enclosure housing a display screen. The viewing panel is mounted to the wall panel on an interior of the wall panel and the enclosure is engageable with the receiving rails on the exterior of the wall panel such that the display screen is movably positioned relative to the viewing panel to be viewable from within the passenger space in an installed position.

In addition to one or more of the features described above, or as an alternative, further embodiments of the elevator cars may include a positioning bracket on at least one receiving rail, wherein the enclosure is engageable with the positioning bracket to position the display screen relative to the viewing panel.

In addition to one or more of the features described above, or as an alternative, further embodiments of the elevator cars may include a positioning pin on the enclosure wherein the positioning pin engages with the positioning bracket.

In addition to one or more of the features described above, or as an alternative, further embodiments of the elevator cars may include that the positioning bracket comprises a track and the positioning pin is arranged to be received within the track.

In addition to one or more of the features described above, or as an alternative, further embodiments of the elevator cars may include a stop bracket arranged on the exterior of the wall panel and positioned to support the enclosure in the installed position.

In addition to one or more of the features described above, or as an alternative, further embodiments of the elevator cars may include that the enclosure comprises at least one enclosure extension arranged to enable manual manipulation of the enclosure.

In addition to one or more of the features described above, or as an alternative, further embodiments of the elevator cars may include a power supply and a display controller housed within the enclosure.

In addition to one or more of the features described above, or as an alternative, further embodiments of the elevator cars may include that the power supply is a battery.

In addition to one or more of the features described above, or as an alternative, further embodiments of the elevator cars may include a maintenance platform deployable from a ceiling of the elevator car.

In addition to one or more of the features described above, or as an alternative, further embodiments of the elevator cars may include that the viewing panel is at least a portion of a mirror.

In addition to one or more of the features described above, or as an alternative, further embodiments of the elevator cars may include that the viewing panel is a transparent material window.

In addition to one or more of the features described above, or as an alternative, further embodiments of the elevator cars may include that the viewing panel defines a surface area greater than the display screen.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
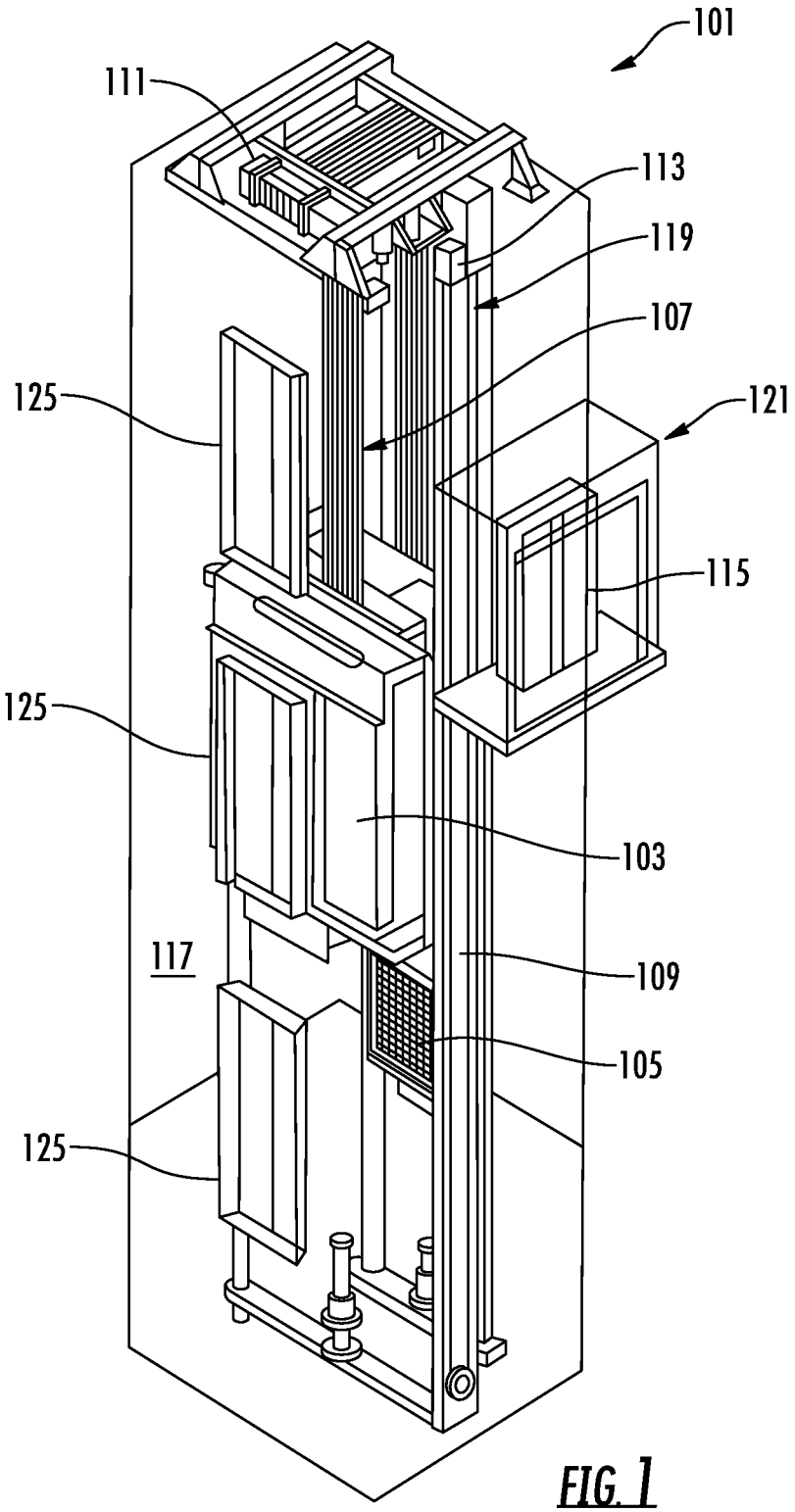
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
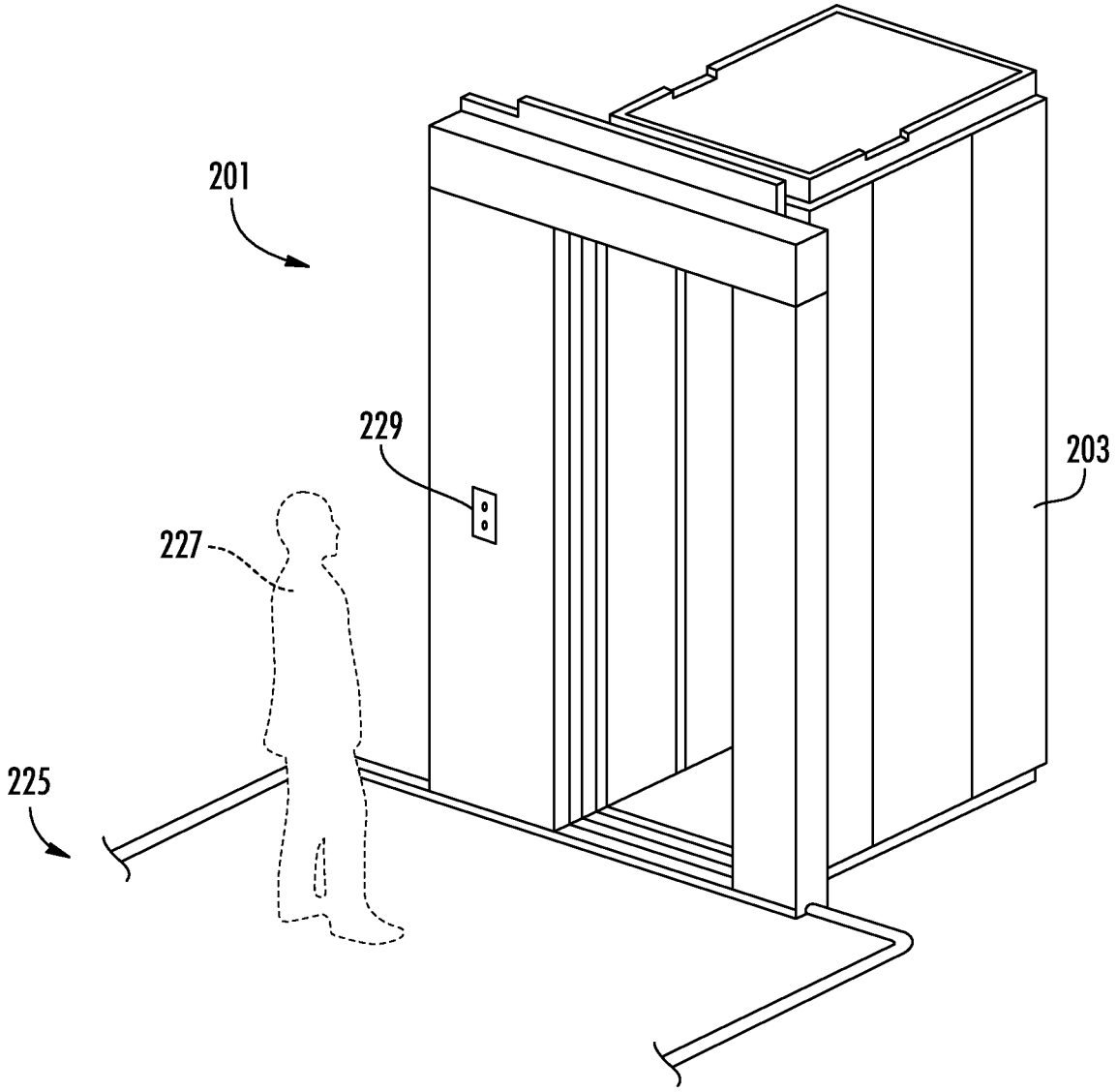
FIG. 2 is a schematic illustration of a landing floor of an elevator system that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger 227 that desires to travel to another floor within a building using a hall call panel 229. The elevator car 203 may include displays for providing visual information to passengers within the elevator car and/or may display advertisements, television, etc. thereon. Further, the elevator car 203 may include a mirror to enable persons facing the mirror to see a reflection, e.g., to determine if a person or passenger is behind the viewer, which may be useful to passengers in wheelchairs or having other disabilities.

It may be desirable to incorporate both large mirrors (to aid passengers with visibility) and large displays (to present information or content) into an elevator car. One way to incorporate both displays and mirrors is to install the display behind the mirror such that the same surface area of a wall or panel of an elevator car includes both the mirror and the display, with the display being visible as a screen behind the mirror. The combined systems, e.g., incorporating a display in the elevator car behind a mirror, may impact maintenance operations and procedures. For example, when a display is integrated behind a mirror, to perform maintenance on the display aesthetics components are typically removed (e.g., wall panels). Such operations and procedures may be time consuming and can risk damage to the aesthetic components (e.g., scratches or damage to panels; damage to the mirror itself, etc.).

Figure 3:
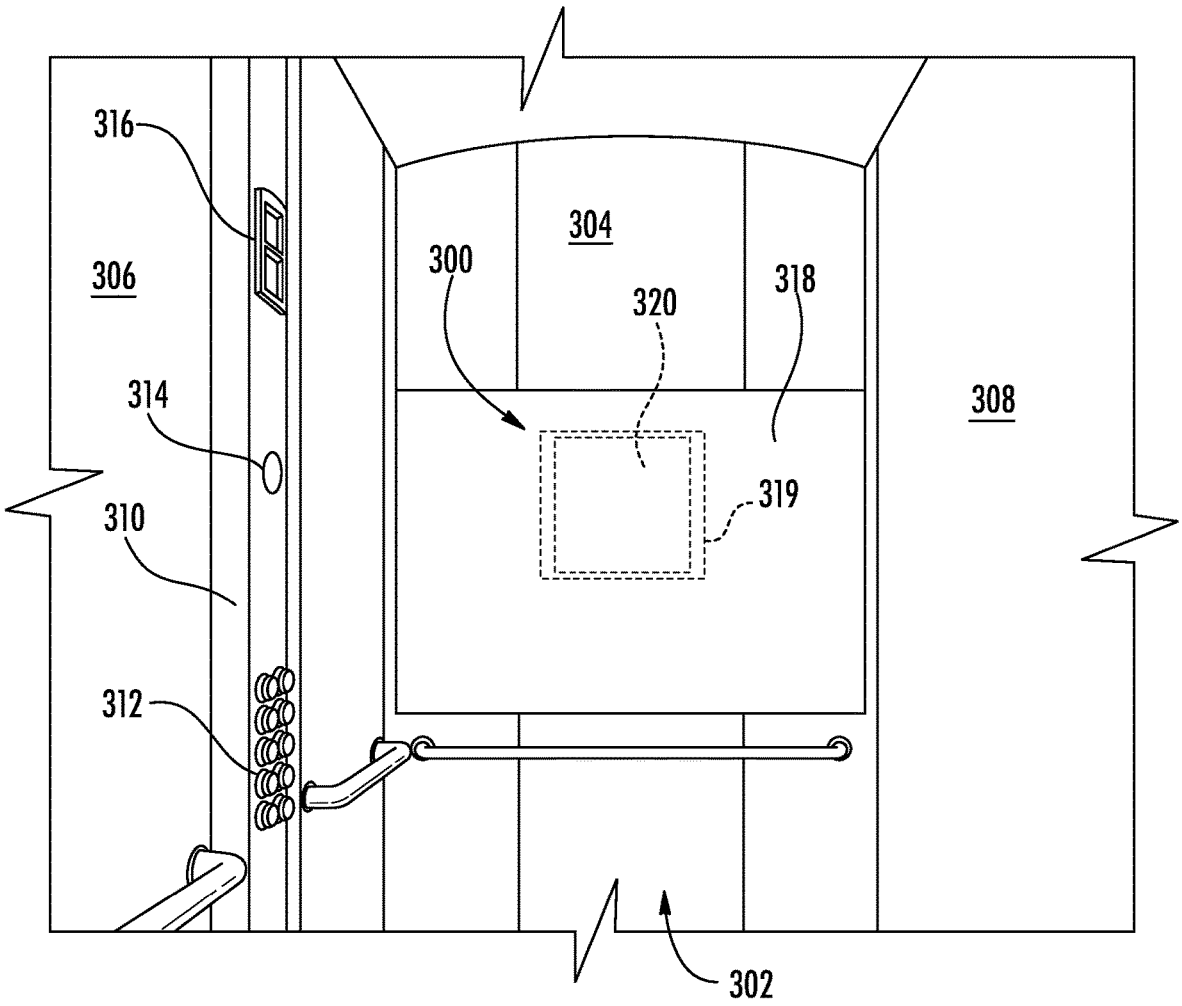
FIG. 3 is a schematic illustration of an interior of an elevator car that may incorporate embodiments of the present disclosure.

Turning now to FIG. 3, a schematic illustration of an elevator display system 300 in accordance with a non-limiting embodiment of the present disclosure is shown. The elevator display system 300, as shown, is installed within an elevator car 302. The elevator car 302 includes wall panels 304, 306, 308 and an elevator car door (not shown). The wall panels 304, 306, 308 define a passenger space of the elevator car 302 and may be mounted to supports, a frame, or other structural members on the exterior of the wall panels 304, 306, 308.

The elevator display system 300 is part of and/or integrated into a first wall panel 304 of the elevator car 302. As shown, the elevator car 302 further includes a car operating panel 310. The car operating panel 310 includes a car control panel 312 (having buttons or other input means), a speaker 314, and an operating display 316. The speaker 314 and the operating display 316 may be configured to provide information to passengers within the elevator car 302 regarding the operation of the elevator car 302. For example, the speaker 314 and the operating display 316 may provide audio and visual information about current location within an elevator shaft (e.g., current landing) and/or destination information. The speaker 314 and the operating display 316 may also provide emergency notification information to passengers within the elevator car 302.

The elevator display system 300 includes a mirror 318, a viewing panel 319, and a display screen 320 that are mounted to and/or integrated into the first wall panel 304, and are visible from the passenger space of the elevator car 302. The viewing panel 319 in this embodiment is a subpart or portion of the mirror 318, and may be transparent to enable viewing of the display screen 320 when the display screen 320 is on. Further, when the display screen 320 is off, the viewing panel 319, in this embodiment, may operate as a mirror. In alternative embodiments, the viewing panel 319 may be a glass, plastic, acrylic, or other transparent material window that does not reflect when the display screen 320 is off. Further, in some embodiments, the mirror 318 (and reflective materials) may be entirely omitted with a viewing panel 319 being arranged within or on the wall panel 304 to provide visibility of the display screen 320. In some embodiments, the mirror 318 or at least the viewing panel 319 of the mirror 318 may be a one-way mirror to enable the display screen 320 to be viewable through the mirror, when the display screen 320 is on.

The display screen 320 can be a television or other display screen positioned within the elevator car 302 to provide various information and/or entertainment within the elevator car 302. The display screen 320 is located behind the mirror 318 and the viewing panel 319 and thus performing maintenance on the display screen 320 may be difficult, requiring removal of the mirror 318, of the viewing panel 319, and/or removal of one or more of the wall panels 304, 306, 308.

However, in accordance with embodiments of the present disclosure, a display package is provided that enables ease of maintenance on such displays. For example, in accordance with some embodiments, a display package is provided having an enclosure that houses a power supply, an electronic board, and a screen as a single unit. The display package allows for ease of manipulation by mechanics or other authorized personnel. During a maintenance operation, instead of removing or opening wall panels or the mirror from within the elevator car, the mechanic may open a foldable ceiling panel and access a maintenance platform to gain access above the elevator car. Once above the elevator car, the mechanic may then perform an installation and/or maintenance operation on the display package from the exterior of the elevator car. The display package may be removable into and from a display guiding system that is on the exterior of the elevator car or at least exterior to the mirror or viewing panel (e.g., behind the mirror or viewing panel). The display guiding system is assembled onto a structural panel or element of the elevator car and is located behind the mirror or viewing panel. Thus, during a maintenance operation, the mechanic may only have to put the display package into the display guiding system to secure the display behind the mirror or viewing panel.

The display package slidingly engages with the display guiding system, which allows for the display to be secured in place behind the viewing panel. The display guiding system allows for vertical sliding from the top of the elevator car and complete translation of the display package behind the viewing panel. The display system of the present disclosure enables the display screen to be positioned close to the back side of the viewing panel in order to be visible from within the elevator car. Then, during maintenance, the mechanic will access the maintenance platform, pull the display package from the display guiding system and remove the entire display package for maintenance.

Figure 4:
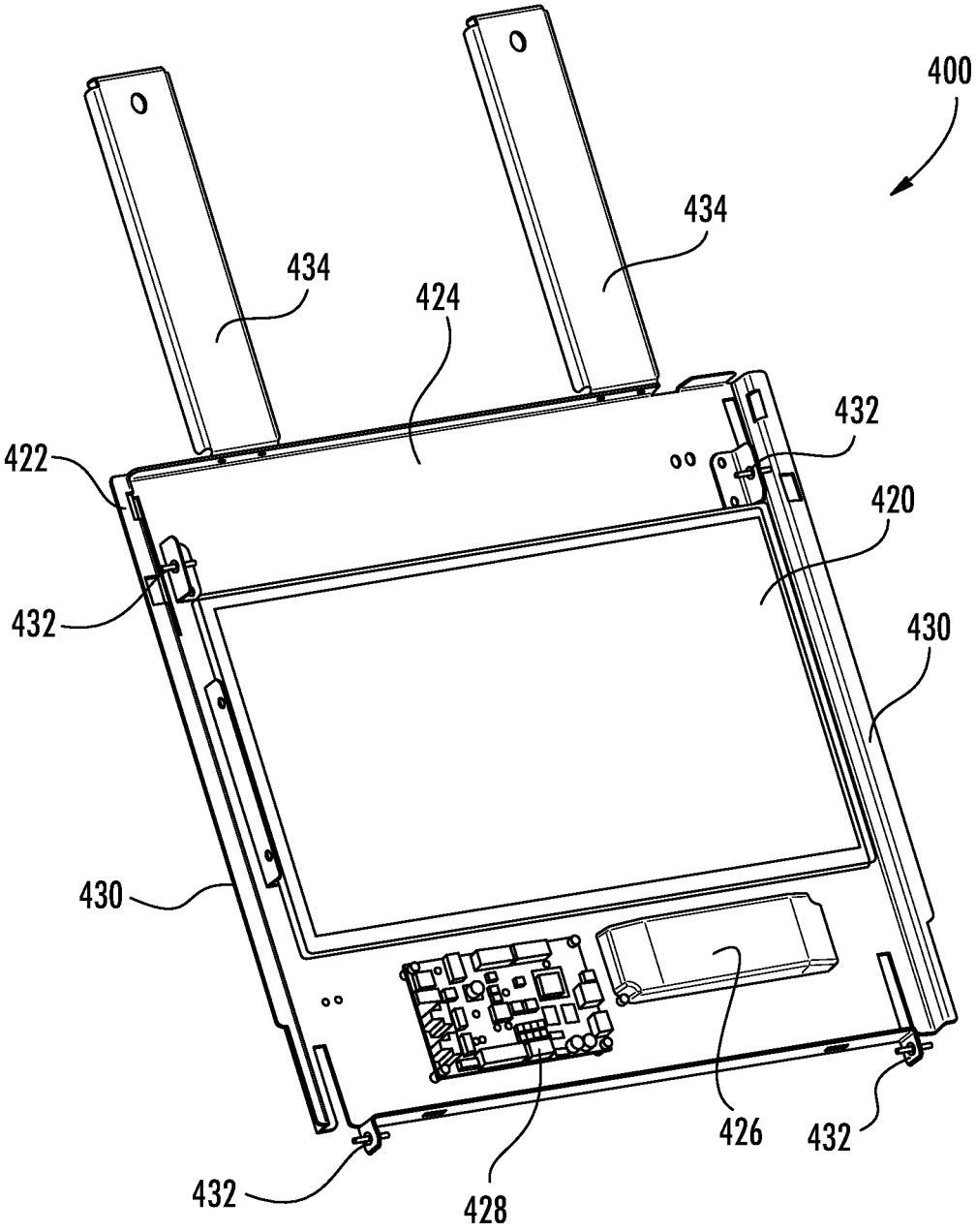
FIG. 4 is a schematic illustration of a part of an elevator display system in accordance with an embodiment of the present disclosure.

Turning now to FIG. 4, a schematic illustration of a backside of a display package 422 of an elevator display system 400 is shown. The display package 422 includes a display screen 420 this is fixed or mounted to an enclosure 424. The enclosure 424 is arranged to support the display screen 420 and other components of the display package 422 and also to releasably engage with a structural frame or panel of an elevator car, as described herein.

As shown, mounted to the enclosure 424 is the display screen 420, a power supply 426, and a display controller 428. The power supply 426 is arranged to supply power to the display controller 428 and the display screen 420. The power supply 426 may be a battery, as illustratively shown. However, in some embodiments, the power supply 426 may be arranged to receive a plug or cord to enable electrical connection between the display package and a power source of the elevator car to which the elevator display system 400 is installed.

The enclosure 424 further includes enclosure rails 430 that are configured to enable installation of the enclosure 424 behind a mirror or viewing panel of the elevator display system 400. The enclosure rails 430 may slidingly engage with and translate along respective receiving rails of the elevator car frame. The enclosure 424 further includes one or more positioning pins 432 that are arranged to engage with a positioning bracket of the elevator car frame, behind the viewing panel, to ensure proper positioning of the display screen 420 behind the viewing panel. Furthermore, as shown, the enclosure 424 includes one or more enclosure extensions 434 that are arranged to aid a mechanic to access and manually move the enclosure 424 (e.g., install and/or remove).

Figure 5A:
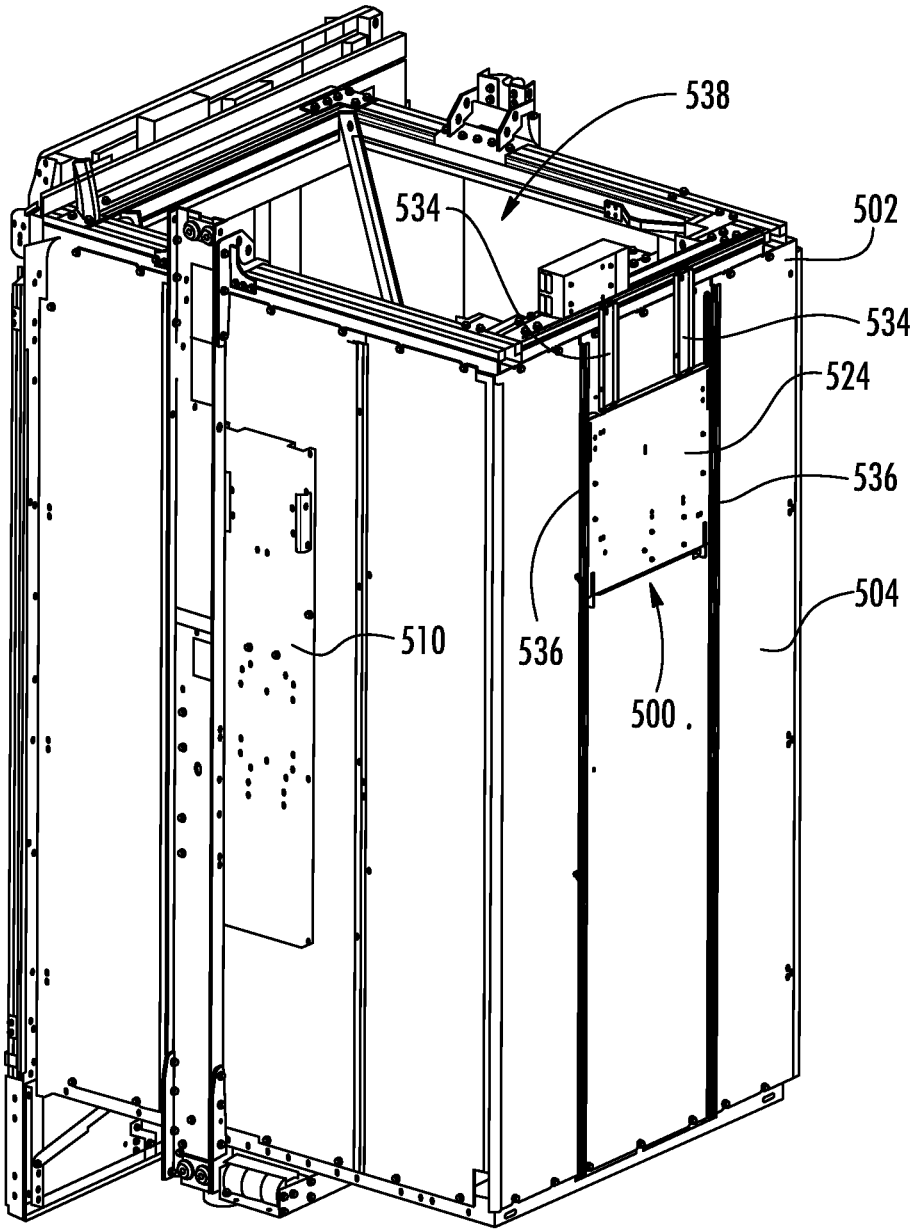
FIG. 5A is a schematic illustration of an elevator car having and elevator display system in accordance with an embodiment of the present disclosure installed thereto.
Figure 5B:
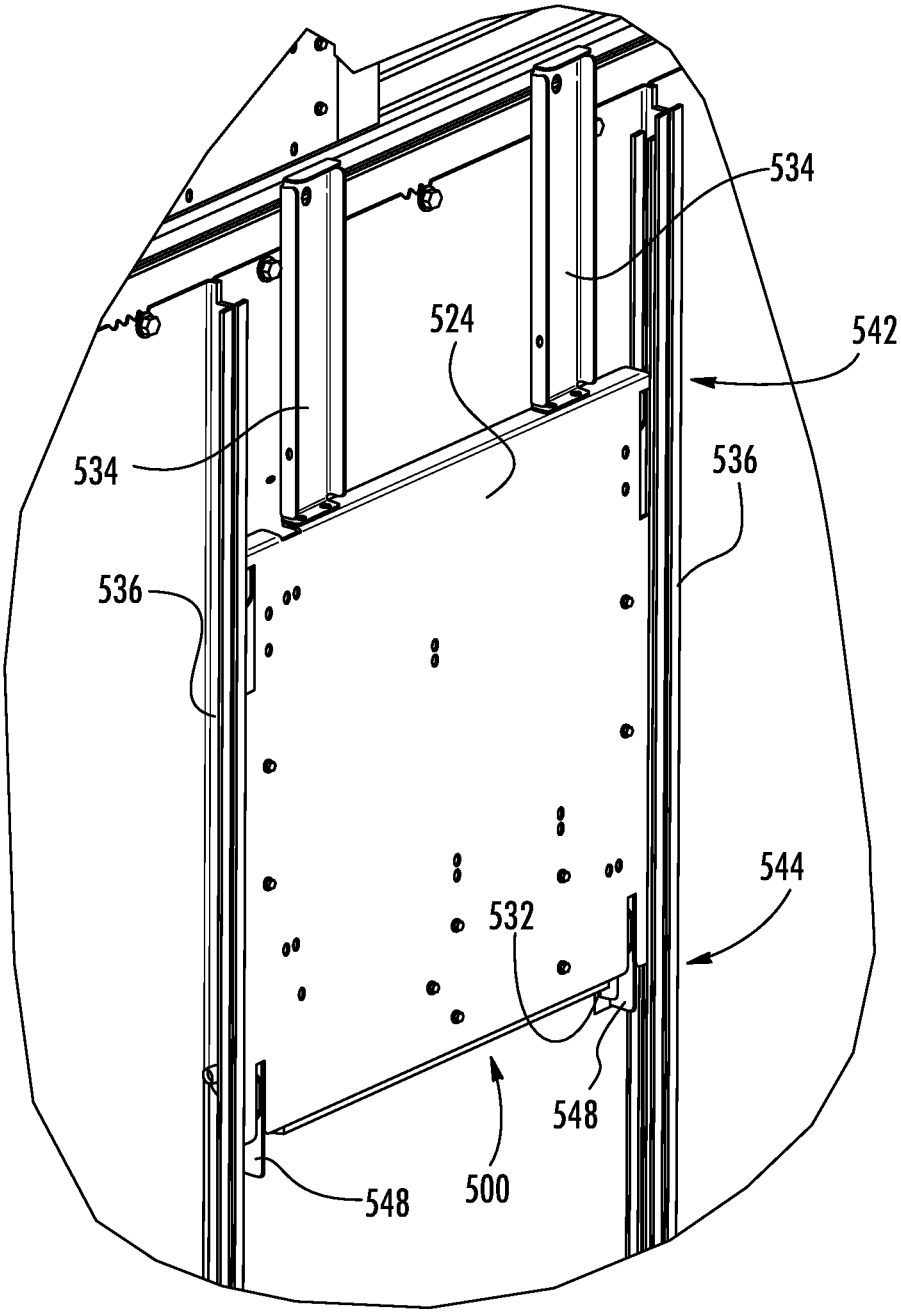
FIG. 5B is an enlarged illustration of the elevator display system of FIG. 5A, illustrating an installed position.
Figure 5C:
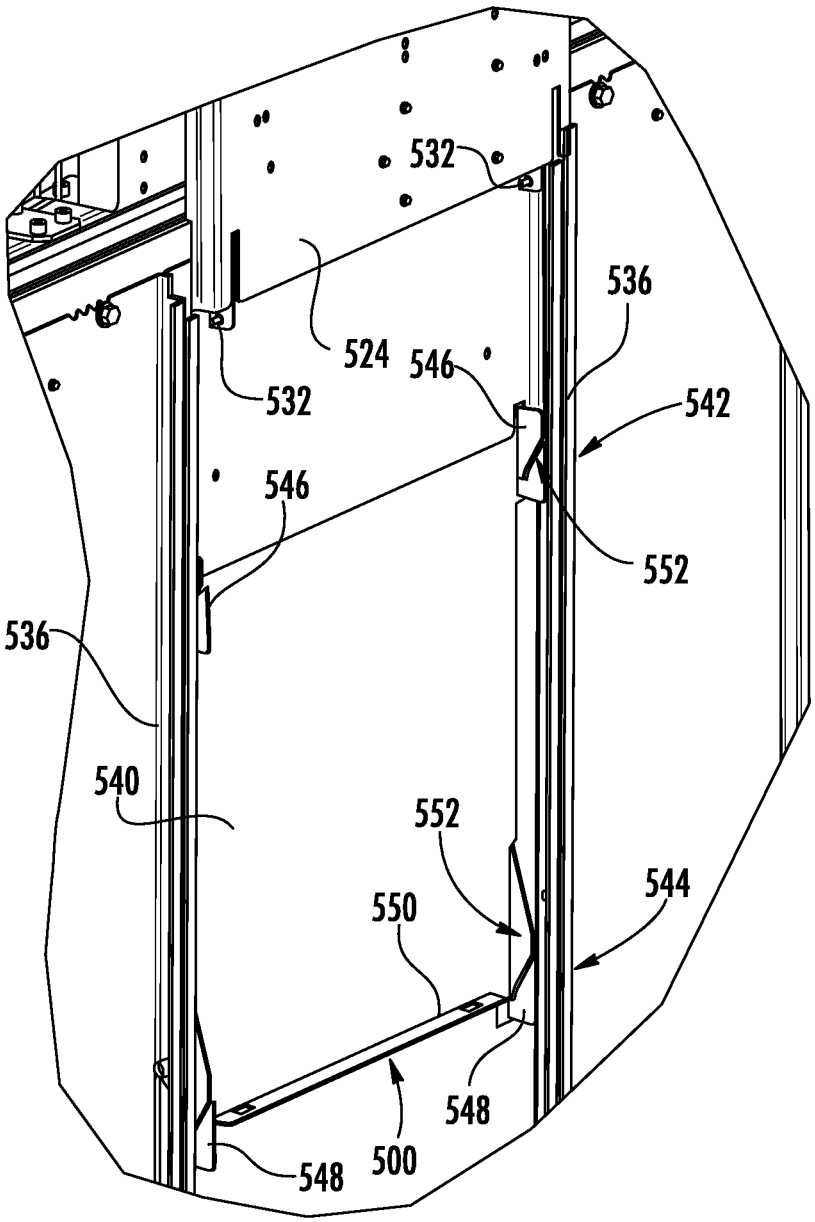
FIG. 5C is an enlarged illustration of the elevator display system of FIG. 5A, partially removed during a maintenance operation.

Turning now to FIGS. 5A-5C, schematic illustrations of an installation process of an elevator display system 500 in accordance with an embodiment of the present disclosure is shown. FIG. 5A is a schematic illustration of an elevator car 502 having an enclosure 524 of the elevator display system 500 installed thereto. FIG. 5B is an enlarged illustration of the enclosure 524 as installed to the elevator car 502 (i.e., an installed position of the enclosure 524). FIG. 5C is an enlarged illustration of the enclosure 524 partially removed during a maintenance operation. The enclosure 524 is substantially similar to the arrangement shown in FIG. 4, housing a display screen, a power supply, and a display controller, but further including a back plate that protects the display screen, the power supply, and the display controller. Also shown in FIG. 5A, the elevator car 502 includes a car operating panel 510.

As shown, the enclosure 524 is installed to receiving rails 536 that are part of a frame of the elevator car 502. The receiving rails 536 are mounted to the back side or exterior of a wall panel 504 of the elevator car 502. In some arrangements the receiving rails 536 are structural members or supports for the wall panel 504. The receiving rails 536 can include slots for receiving enclosure rails of the enclosure 524 and/or positioning brackets to receive positioning pins 532 of the enclosure 524.

As shown, an access opening 538 is schematically shown in the ceiling or top of the elevator car 502. The access opening 538 may be arranged as a drop panel or platform of the ceiling of the elevator car 502. In some embodiments, as described below, a platform may unfold from the ceiling and allow a mechanic or other person to gain access to the top of the elevator car 502 through the access opening 538. A mechanic may then access the enclosure 524 and the electronics and components thereof by removing the enclosure 524 from engagement using one or more enclosure extensions 534.

Turning now to FIG. 5B, an enlarged illustration of the enclosure 524 installed to the receiving rails 536 is schematically shown. The enclosure 524 is positioned behind a viewing panel 540, e.g., a portion of a mirror, as shown in FIG. 5C), with the viewing panel 540 located on a panel of the elevator car 502. As shown, the enclosure extensions 534 extend from a first end 542 of the elevator display system 500 and one or more positioning pins 532 are located at a second end 544 of the elevator display system 500. Although not visible, the enclosure 524 may include one or more positioning pins at the first end 542 to engage with respective positioning brackets.

Turning now to FIG. 5C, a schematic illustration of the enclosure 524 as removed from engagement with the receiving rails 536 of the elevator car 502 is shown. The receiving rails 536 and a number of brackets are provided to guide and support the enclosure 524 during installation and operation. For example, as shown, first positioning brackets 546 are arranged on the receiving rails 536 at the first end 542 of the elevator display system 500. The first positioning brackets 546 may receive respective positioning pins of the enclosure 524 (e.g., at the first end 542 of the elevator display system 500, when the enclosure 524 is installed). Further, second positioning brackets 548 are arranged on the receiving rails 536 at the second end 544 of the elevator display system 500. The second positioning brackets 548 may receive respective positioning pins of the enclosure 524 (e.g., at the second end 544 of the elevator display system 500, when the enclosure 524 is installed). A stop bracket 550 is also arranged at the second end 544 of the elevator display system 500, and is arranged to support the bottom or lower end of the enclosure 524 when the enclosure 524 is installed.

The positioning brackets 546, 548 include slots or tracks 552 to receive the positioning pins of the enclosure 524. The tracks 552 of the positioning brackets 546, 548 may be angled such that during installation of the enclosure 524 into the positioning brackets 546, 548, the enclosure 524 is moved into contact or close proximity with the viewing panel 540. That is, the positioning brackets 546, 548 are arranged to ensure proper installation and positioning of the display screen of the elevator display system 500 relative to the viewing panel 540 of the elevator display system 500. Further, the tracks 552 are arranged to ensure that during installation and/or removal of the enclosure 524 from the installed position (FIG. 5B), the enclosure 524 (or parts thereof) do not contact the viewing panel 540 and thus damage thereto can be avoided.

Figure 6:
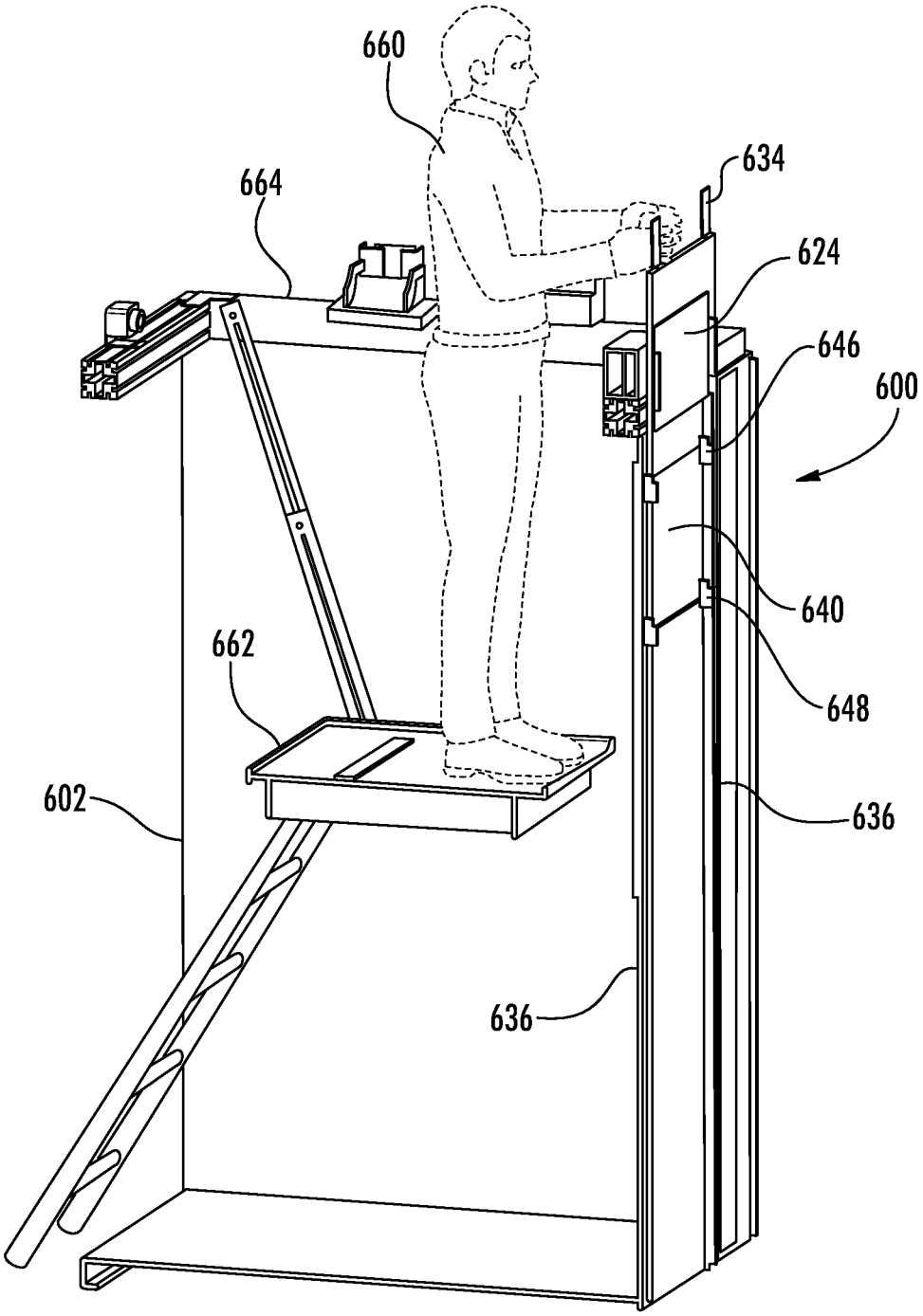
FIG. 6 is a schematic illustration of a mechanic performing a maintenance operation on an elevator display system in accordance with an embodiment of the present disclosure.

Turning now to FIG. 6, a schematic illustration of a mechanic 660 performing a maintenance operation on an elevator display system 600 in accordance with an embodiment of the present disclosure is shown. The elevator display system 600 is similar to that shown and described above, and thus similar features may not be described in detail again. The elevator display system 600 includes a viewing panel 640 and an enclosure 624 housing a display screen, a power supply, and a display controller. The enclosure 624 is engageable with one or more positioning brackets 646, 648 that are part of or mounted to one or more receiving rails 636. The mechanic 660 is shown standing on a maintenance platform 662 that is suspended from a top 664 of an elevator car 602. The mechanic 660 may access and move the enclosure 624 by using one or more enclosure extensions 634, as described above.

Although the exterior views shown in FIGS. 5A-6 illustrate a relatively small viewing panel that is the same size as the enclosure, such arrangements are not to be limiting. For example, the viewing panel shown in the illustrations may only be a part of a larger viewing panel or mirror (e.g., as shown in FIG. 3). That is, the viewing panel and the display screen of the elevator display systems of the present disclosure may be the same size, or may be different sizes, with the viewing panel typically being larger than the display screen.

Advantageously, embodiments of the present disclosure facilitate the installation and maintenance of displays that are located behind viewing panel (e.g., mirrors or other windows) within an elevator car. Embodiments provided herein can greatly reduce maintenance times for installation and maintenance operations associated with displays. Moreover, advantageously, embodiments provided herein can reduce risk to damage aesthetic component in an elevator car during installation and maintenance operations of displays thereof.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car comprising:

a wall panel defining part of a passenger space of the elevator car;

two or more receiving rails arranged on an exterior of the wall panel; and an elevator display system having a viewing panel and an enclosure housing a display screen, wherein the viewing panel is mounted to the wall panel on an interior of the wall panel and the enclosure is engageable with the receiving rails on the exterior of the wall panel such that the display screen is movably positioned relative to the viewing panel to be viewable from within the passenger space in an installed position.

2. The elevator car of claim 1, further comprising a positioning bracket on at least one receiving rail, wherein the enclosure is engageable with the positioning bracket to position the display screen relative to the viewing panel.

3. The elevator car of claim 2, further comprising a positioning pin on the enclosure wherein the positioning pin engages with the positioning bracket.

4. The elevator car of claim 3, wherein the positioning bracket comprises a track and the positioning pin is arranged to be received within the track.

5. The elevator car of claim 2, further comprising a stop bracket arranged on the exterior of the wall panel and positioned to support the enclosure in the installed position.

6. The elevator car of claim 2, wherein the enclosure comprises at least one enclosure extension arranged to enable manual manipulation of the enclosure.

7. The elevator car of claim 2, further comprising a power supply and a display controller housed within the enclosure.

8. The elevator car of claim 2, wherein the viewing panel is at least a portion of a mirror.

9. The elevator car of claim 2, wherein the viewing panel is a transparent material window.

10. The elevator car of claim 2, wherein the viewing panel defines a surface area greater than the display screen.

11. The elevator car of claim 1, further comprising a stop bracket arranged on the exterior of the wall panel and positioned to support the enclosure in the installed position.

12. The elevator car of claim 1, wherein the enclosure comprises at least one enclosure extension arranged to enable manual manipulation of the enclosure.

13. The elevator car of claim 1, further comprising a power supply and a display controller housed within the enclosure.

14. The elevator car of claim 13, wherein the power supply is a battery.

15. The elevator car of claim 1, further comprising a maintenance platform deployable from a ceiling of the elevator car.

16. The elevator car claim 1, wherein the viewing panel is at least a portion of a mirror.

17. The elevator car of claim 1, wherein the viewing panel is a transparent material window.

18. The elevator car claim 1, wherein the viewing panel defines a surface area greater than the display screen.

* * * * *